US007043190B2

(12) United States Patent
Tohata

(10) Patent No.: US 7,043,190 B2
(45) Date of Patent: May 9, 2006

(54) IMAGE FORMING APPARATUS EMPLOYING ELECTRO-PHOTOGRAPHIC PROCESS AND CONTROLLING METHOD OF THE SAME

(75) Inventor: Nobuo Tohata, Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 92 days.

(21) Appl. No.: 10/806,468

(22) Filed: Mar. 23, 2004

(65) Prior Publication Data

US 2005/0214047 A1 Sep. 29, 2005

(51) Int. Cl.
*G03G 21/00* (2006.01)

(52) U.S. Cl. ..... 399/359; 399/63

(58) Field of Classification Search ..... 399/51, 399/63, 358, 99, 359, 360, 252
See application file for complete search history.

(56) References Cited

U.S. PATENT DOCUMENTS 5,508,793 A * 4/1996 Kimura et al. ..... 399/63
5,950,062 A * 9/1999 Yahata et al. ..... 399/358
6,832,058 B1 * 12/2004 Akita et al. ..... 399/51

FOREIGN PATENT DOCUMENTS

JP 11-352758 A 12/1999

* cited by examiner

*Primary Examiner*—Brij B. Shrivastav
(74) *Attorney, Agent, or Firm*—Foley & Lardner LLP

(57) ABSTRACT

In an image forming apparatus having a toner recycle mechanism employing a two-components developing system, rotational torque of a stirring screw disposed within a developing device and capacity of a recycle toner within the developing device are detected. Where the rotational torque of stirring screw is elevated and the capacity of the recycle toner is increased, control operation for not changing a development bias voltage and lowering rotational speed of the stirring screw is executed. Where the rotational torque of the stirring screw is elevated and the capacity of the recycle toner is not increased, control operation for not changing rotational speed of the stirring screw is executed.

6 Claims, 5 Drawing Sheets

| | | grasping of circumstances by sensor | | | image characteristics before control | | |
|---|---|---|---|---|---|---|---|
| | development | developing roller rear side toner | developing device stirring torque | recovered toner level sensor | fog | scattering | image density |
| reference value | | 6.5 | 1.8 | 13 | | | |
| unit | | % | kg·cm | mm (height from bottom) | | | |
| management width | | 6.5±0.5 | 1.4-2.2 | 8-18 | | | |
| embodiment 1 | at the time of stabilization of toner density | 6.5 | 1.8 | 18 | ○ | ○ | ○ |
| embodiment 2 | large quantity of recovered toner supplied | 6.5 | 2.3 | 20 | × | × | ○ |
| embodiment 3 | developer deteriorated | 6.5 | 2.3 | 11 | × | × | ○ |
| embodiment 4 | toner empty | 5.9 | 2.3 | 11 | ○ | ○ | × |

FIG. 2

| | feedback control method | | | | image characteristics after control | | |
|---|---|---|---|---|---|---|---|
| | development bias | waiting mode | developing device | fresh toner supplied | fog | scattering | image density |
| reference value | E | | F | | | | |
| unit | | | | | | | |
| management width | | | | | | | |
| embodiment 1 | E | off | F | off | ○ | ○ | ○ |
| embodiment 2 | E | on | 0.7F | off | ○ | ○ | ○ |
| embodiment 3 | 1.3E | off | F | off | ○ | ○ | ○ |
| embodiment 4 | E | on | F | on | ○ | ○ | ○ |

FIG. 3

| | | grasping of circumstances by sensor | | | image characteristics before control | | |
|---|---|---|---|---|---|---|---|
| | development | developing roller rear side toner | developing device stirring torque | recovered toner level sensor | fog | scattering | image density |
| reference value | | 6.5 | 1.8 | 13 | | | |
| unit | | % | kg·cm | mm (height from bottom) | | | |
| management width | | 6.5±0.5 | 1.4-2.2 | 8-18 | | | |
| comparative example 1 | large quantity of recovered toner supplied | 6.5 | 2.3 | not detected (actually 24) | × | × | ○ |
| comparative example 2 | developer deteriorated | 6.5 | 2.3 | not detected (actually 16) | × | × | ○ |

FIG. 4

| | feedback control method | | | | image characteristics after control | | |
|---|---|---|---|---|---|---|---|
| | development bias | waiting mode | developing device | fresh toner supplied | fog | scattering | image density |
| reference value | E | | F | | | | |
| unit | | | | | | | |
| management width | | | | | | | |
| comparative example 1 | 1.3E | off | F | off | × | × | ○ |
| comparative example 2 | 1.3E | off | F | off | ○ | ○ | ○ |

FIG. 5

IMAGE FORMING APPARATUS EMPLOYING ELECTRO-PHOTOGRAPHIC PROCESS AND CONTROLLING METHOD OF THE SAME

BACKGROUND OF THE INVENTION

1. Field of the Invention

The present invention relates an image forming apparatus employing an electro-photographic process such as a laser printer, an electro-photographic copying machine and the like, and particularly, to an image forming apparatus having a toner recycle mechanism, and a controlling method therefor.

2. Related Art Statement

In an Image forming apparatus 1 employing an electro-photographic process such as a laser printer, an electrophotographic copying machine and the like, as shown in FIG. 1, first, the surface of a photosensitive drum 2 is charged by a charging device 3 to a fixed surface potential, then the surface of the photosensitive drum 2 is exposed by an exposing device 4 such as a semiconductor laser, and the surface potential is decayed to form an electrostatic latent image. And, a bias voltage is applied to the surface of a developing roller 6 of a developing device 5, toner charged within the developing device 5 is adhered to an electrostatic latent image forming section on the surface of the photosensitive drum 2, developed and actualized to form a toner image on the surface of the photosensitive drum 2.

On the other hand, paper P is carried to a transfer region by carrying rollers 7, 7, the paper P is charged by a transfer device 8, and a toner image formed on the surface of the photosensitive drum 2 is transferred to the surface of the paper P. The paper P is stripped from the surface of the photosensitive drum 2 by a stripping device 9, a toner image is fixed to the surface of the paper P by a fixing device (not shown), and the paper P is discharged outside the device by a discharging roller (not shown).

After the toner image has been transferred to the surface of the paper P, toner remained on the surface of the photosensitive drum 2 is scraped off by a blade 11 of a cleaning device 10 to recover it, and then a load remained on the surface of the photosensitive drum 2 is removed by an eliminator 12 to place the surface of the photosensitive drum 2 in an initial state.

In a developing device 5 employing a two-components developing system, as shown in FIG. 1, a developer D comprising a carrier C as magnetic powder and a toner T as colored resin powder is encased in the developing device 5, the carrier C and the toner T are mixed and stirred by stirring screws 13, 14, and the toner is charged by friction. When the toner T is consumed by development, toner $T_F$ is supplied from a toner hopper 15 into the developing device 5, and the supplied toner $T_F$ is mixed with the carrier C, stirred and charged, in a manner similar to that described above.

A toner recycle mechanism 16 is constituted by a carrying screw 17 disposed within the cleaning device 10, a toner carrying tube 18 for communications between the cleaning device 10 and the developing device 5, a carrying screw 19 disposed within the toner carrying tube 18, and the like. Toner $T_R$ recovered into the cleaning device 10 is introduced into a toner carrying tube 18 by the carrying screw 17, and carried into the toner carrying tube 18 by a carrying screw 19, and the toner $T_R$ is supplied into the developing device 5.

When the developing device 5 is continued to be driven for a long period of time, toner T being mixed and stirred becomes deteriorated, and a degree of agglomeration of toner T within the developing device 5 changes also. When a degree of agglomeration of toner T within the developing device 5 becomes excessively low, a quantity of toner adhered to the surface of the photosensitive drum 2 increases, and therefore a fog phenomenon occurs in which fine toner is adhered to the whole paper P. On the other hand, when a degree of agglomeration of toner T within the developing device 5 becomes excessively high, a quantity of toner adhered to the surface of the photosensitive drum 2 decreases, and therefore an unevenness in density occurs in a toner image formed on paper P.

In view of the foregoing, there has been proposed an image forming apparatus wherein in order that, even if a degree of agglomeration of toner T within the developing device 5 is changed, an image which is excellent in quality and stabilized in density can be formed on paper P, a degree of agglomeration of toner T is detected on the basis of rotational torque of the stirring screws 13, 14, and a development bias voltage is controlled corresponding to the degree of agglomeration of toner T (see Japanese Patent Application Laid-Open No. Hei 11-352758 Publication).

However, in the image forming apparatus having a toner recycle mechanism sometimes involves a case where a large quantity of recycle toner $T_R$ recovered is supplied into the developing device 5, and the rotational torque of the stirring screws 13, 14 elevates. In such a case as described, as disclosed in Japanese Patent Application Laid-Open No. Hei 11-352758 Publication, even if a development bias voltage is made high, a phenomenon such as fog in paper P or scattering of toner is not improved because an amount of charge of toner T present within the developing device 5 (fresh toner $T_F$ and recycle toner $T_R$) is uneven.

That is, it is contemplated that dominant causes that a degree of agglomeration of toner T within the developing device 5 changes are both 1) a deterioration of toner T, and 2) an excessively large supply of recycle toner $T_R$). However, the fact that by which dominant cause the degree of agglomeration of toner T within the developing device 5 was changed cannot be judged merely by detecting the rotational torque of the stirring screws 13, 14. Therefore, in the image forming apparatus disclosed in Japanese Patent Application Laid-Open No. Hei 11-352758 Publication, the phenomenon such as fog in paper P or scattering of toner could not be improved positively.

SUMMARY OF THE INVENTION

The present invention has been accomplished in view of the conventional problems in the image forming apparatus having a toner recycle mechanism. An object of the invention is to provide an image forming apparatus capable of effectively preventing a fog or toner scattering from occurring on a white ground of paper, and unevenness of density from occurring on an image formed on paper.

For achieving the aforesaid object, an image forming apparatus according to an embodiment of the present invention is characterized in that rotational torque of a stirring screw disposed within a developing device and capacity of recycle toner within a developing device are detected, and where the rotational torque of the stirring screw is elevated and the capacity of the recycle toner is increased, control operation for lowering a rotational speed of the stirring screw is executed without changing a development bias voltage, and where the rotational torque of the stirring screw is elevated and the capacity of the recycle toner is not increased, control operation for elevating a development bias voltage is elevated and the rotational speed of the stirring screw is not changed.

BRIEF DESCRIPTION OF THE DRAWINGS

FIG. 2 is a table showing image characteristics in various situations;

FIG. 3 is a table showing a control method and image characteristics in an image forming apparatus according to an embodiment of the present invention;

FIG. 4 is a table showing image characteristics in various situations; and

FIG. 5 is a table showing a control method and image characteristics in a conventional image forming apparatus.

DETAILED DESCRIPTION OF THE INVENTION

Figure 1:
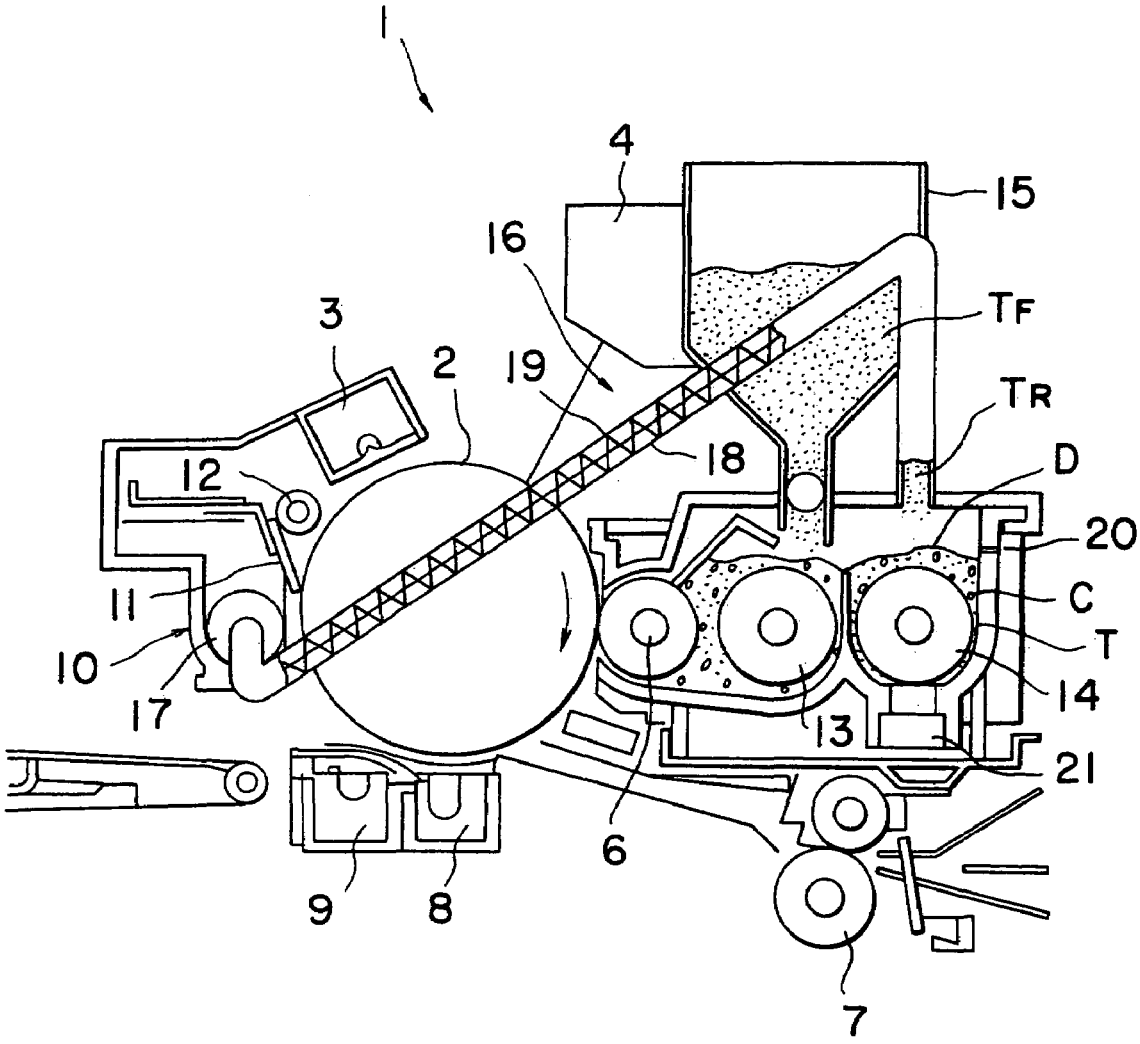
FIG. 1 is a sectional view of an image forming apparatus according to the present invention.

An embodiment of an image forming apparatus having a toner recycle mechanism employing a two-components developing system will be described in detail hereinafter with reference to the drawings.

An image forming apparatus 1 comprises, as shown in FIG. 1, a photosensitive drum 2, a charging device 3 for charging the surface of the photosensitive drum 2, an exposing device 4 such as a semiconductor laser for irradiating light on the surface of the photosensitive drum 2 to form a required electrostatic latent image, a developing roller 6 for holding and carrying toner, a developing device 5 for actualizing an electrostatic latent image formed on the surface of the photosensitive drum 2, a transfer device 8 for transferring a toner image formed on the surface of the photosensitive drum 2 to the surface of paper P, a stripping device 9 for stripping paper P from the surface of the photosensitive drum 2, a blade 11 for scraping off toner remained on the surface of the photosensitive drum 2, a cleaning device 10 for cleaning the remained toner, an eliminator 12 for removing a load remained on the surface of the photosensitive drum 2, and the like.

The developing device 5 receives therein, as shown in FIG. 1, a developer D comprising a carrier C and a toner T, and comprises a developing roller 6 for holding and carrying toner T, stirring screws 13, 14 for mixing and stirring the carrier C and the toner T, and the like, being provided with a toner hopper for supplying fresh toner $T_F$.

The image forming apparatus 1 has a toner recycle mechanism 16, and the toner recycle mechanism 16 comprises a carrying screw 17 disposed within the cleaning device 10, a toner carrying tube 18 for communications between the cleaning device 10 and the developing device 5, a carrying screw 19 disposed within the toner carrying tube 18, and the like.

The toner T received within the developing device 5 is mixed and stirred by the stirring screws 13, 14, and charged to negative polarity by friction. The carrier C having magnetism is magnetic adsorbed in the surface of the developing roller 6 whereby the toner T electrostatic adsorbed is also held and carried to the surface of the developing roller 6. A bias voltage is applied to the surface of the developing roller 6 whereby the toner T held and on the surface of the developing roller 6 is electrostatic adhered to an electrostatic latent image forming portion of the surface of the photosensitive drum 2 to form a toner image on the surface of the photosensitive drum 2.

The toner image formed on the surface of the photosensitive drum 2 is transferred to the surface of paper P by the transfer device 8, but the toner remained on the surface of the photosensitive drum 2 after transfer is scraped off by the blade 11 and recovered into the cleaning device 10. The toner $T_R$ recovered into the cleaning device 10 is introduced into the toner carrying tube 18 by the carrying screw 17, and carried to the developing device 5 while flowing into the toner carrying tube 18 by means of the carrying screw 19.

Where toner T is consumed by development, fresh toner $T_F$ is supplied from the toner hopper 15 into the developing device 5, and recycle toner $T_R$ is supplied from the cleaning device 10, and the supplied toners $T_F$, $T_R$ are mixed with the carrier C and stirred, and charged to negative polarity by friction.

In the image forming apparatus 1 according to the present embodiment, toner density in the developer D, rotational torque of the stirring screws 13, 14, and capacity of the recycle toner $T_R$ are detected in order to grasp the circumstances of toner T in the developer D.

The toner density in the developer D is detected by disposing a toner density sensor 21 downwardly of the stirring screw 14 and on the basis of a change in permeability of the developer D; the rotational torque of the stirring screws 13, 14 is detected on the basis of a change in current of a motor driving the stirring screws 13, 14; and the capacity of the recycle toner $T_R$ is detected by disposing a level sensor 20 in the vicinity of a supply port of the recycle toner $T_R$ and on the basis of a change in height of the developer D.

The image forming apparatus according to the present embodiment is characterized in that the dominant cause of changing a degree of agglomeration of toner F within the developing device 5, which could not be judged merely by detecting the rotational torque of the stirring screws 13, 14, can be judged in a manner such that the capacity of the recycle toner $T_R$ is detected whereby either 1) deterioration of toner T or 2) excessive supply of the recycle toner $T_R$ is discriminated positively.

The fact that even if the rotational torque of the stirring screws 13, 14 is elevated, the height of the developer D is elevated and the capacity of the recycle toner $T_R$ is increased is discriminated as the dominant cause of the 2) excessive supply of the recycle toner $T_R$, and the rotational speed of the stirring screws 13, 14 is lowered without elevating the development bias voltage, the staying time within the developing device 5 of the recycle toner $T_R$ is sufficiently extended, and charging is done till the good condition is obtained.

It is noted that such a control operation as described is executed before starting of print or at the time of waiting for print after termination of print. However, where the fact that an increase in capacity of the recycle toner $T_R$ is detected at the time of continuous print, the continuous print operation is forcibly stopped, and the operation is executed as the print waiting state.

In a case where toner T in the developer D is in various circumstances, image characteristics when print operation is executed, and fixed control operation to be executed and image characteristics when print operation is executed later will be specifically described referring to embodiments.

EMBODIMENTS 1 TO 4

Where the image forming apparatus 1 shown in FIG. 1 is used, and toner T in the developer D is in various circumstances, toner density in the developer D, rotational torque of the stirring screws 13, 14, and capacity of the recycle toner $T_R$ are detected, and image characteristics when print operation is executed was confirmed. The results are as shown in FIG. 2.

Here, toner density in the developer D is that 6.5% is a reference value, and its ±0.5% is an allowable range; rotational torque of the stirring screws 13, 14 is that 1.8 kg·cm is a reference value, and 1.4 to 2.2 kg·cm is an allowable range; and capacity of the recycle toner $T_R$ is that 13 mm is a reference value, and 8 to 18 mm is an allowable range.

In case of the embodiment 1, toner density in the developer D is 6.5%, rotational torque of the stirring screws 13, 14 is 1.8 kg cm, and capacity of the recycle toner $T_R$ is 18 mm, which are the state that the toner density in the developer D is stabilized, the image density is sufficient and the fog as well as toner scattering are rarely found.

In case of the embodiment 2, toner density in the developer D is 6.5%, rotational torque of the stirring screws 13, 14 is 2.3 kg·cm, and capacity of the recycle toner $T_R$ is 20 mm, which are the state that a supply of the recycle toner $T_R$ is excessive, the image density is sufficient but the fog and toner scattering are found to be considerably much.

In case of the embodiment 3, toner density in the developer D is 6.5%, rotational torque of the stirring screws 13, 14 is 2.3 kg cm, and capacity of the recycle toner $T_R$ is 11 mm, which are the state that the developer D is deteriorated, the image density is sufficient but the fog and toner scattering are found to be considerably much.

In case of the embodiment 4, toner density in the developer D is 5.9%, rotational torque of the stirring screws 13, 14 is 2.3 kg cm, and capacity of the recycle toner $T_R$ is 11 mm, which are the state that the developer D is lowered, the image density is lowered but the fog and toner scattering are rarely found.

Next, with respect to the cases of the embodiments 1 to 3, image characteristics when print operation is executed after fixed control operation was executed were confirmed. The results are as shown in FIG. 3.

Here, the development bias voltage is that E is a reference value, and the rotational speed of the stirring screws 13, 14 is that F is a reference value.

In the case of the embodiment 1, since the toner density in the developer D is in the stabilized state, no control operation was not executed.

In the case of the embodiment 2, since the state is that the rotational torque of the stirring screws 13, 14 is elevated, the capacity of the recycle toner $T_R$ is also increased, and the supply of the recycle toner $T_R$ is excessive, the rotational speed of the stirring screws 13, 14 was lowered. By such a control operation as described, the fog and toner scattering were rarely found.

In the case of the embodiment 3, since the state is that the rotational torque of the stirring screws 13, 14 is elevated, the capacity of the recycle toner $T_R$ is reduced, and the developer D is deteriorated, the development bias voltage was elevated. By such a control operation as described, the fog and toner scattering were rarely found.

In the case of the embodiment 4, since the state is that the toner density in the developer D is lowered, fresh toner $T_F$ was supplied into the developing device 5. By such a control operation as described, the image density was elevated to assume the good state.

COMPARATIVE EXAMPLES 1 AND 2

Where the image forming apparatus 1 shown in FIG. 1 is used, and toner T in the developer D is in various circumstances, toner density in the developer D, and rotational torque of the stirring screws 13, 14 are detected, but capacity of the recycle toner $T_R$ is not detected, and image characteristics when print operation is executed was confirmed. The results are as shown in FIG. 4.

In the case of the comparative example 1, toner density in the developer D is 6.5%, and rotational torque of the stirring screws 13, 14 is 2.3 kg.cm, but capacity of the recycle toner $T_R$ is not detected. Therefore, either 1) the state that the developer D is deteriorated or 2) the state that the supply of the recycle toner $T_R$ is excessive cannot be discriminated, and the image density is sufficient but the fog and toner scattering were found to be considerably much.

Also, in the case of the comparative example 2, toner density in the developer D is 6.5%, and rotational torque of the stirring screws 13, 14 is 2.3 kg.cm, but capacity of the recycle toner $T_R$ is not detected. Therefore, either 1) the state that the developer D is deteriorated or 2) the state that the supply of the recycle toner $T_R$ is excessive cannot be discriminated, and the image density is sufficient but the fog and toner scattering were found to be considerably much.

Next, with respect to the cases of the comparative examples 1 and 2, the image characteristics when the print operation was executed after the fixed control operation has been executed were confirmed. The results are as shown in FIG. 5.

In the case of the comparative example 1, since the rotational torque of the stirring screws 13, 14 was elevated, the development bias voltage was elevated. However, by such a control operation as described, the fog and toner scattering were hardly improved.

Also, in the case of the comparative example 2, since the rotational torque of the stirring screws 13, 14 was elevated, the development bias voltage was elevated. However, by such a control operation as described, the fog and toner scattering were hardly found.

As described above, in the case of the comparative example 1, since the capacity of the recycle toner $T_R$ is not detected, either 1) the state that the developer D is deteriorated or 2) the state that the supply of the recycle toner $T_R$ is excessive cannot be discriminated, and the fog and toner scattering could not be improved positively.

While in the present embodiments, the two-components developer has been used, it is to be noted that the present invention can be also applied to a single component developer not containing a carrier C.

Further, while in the present embodiments, as a toner density sensor, the sensor for detecting a change in permeability has been used, it is to be noted that a light reflecting type sensor arranged opposite to a developing roller or a photosensitive drum or the like may be used.

What is claimed is:

1. An image forming apparatus having a toner recycle mechanism, wherein rotational torque of a stirring member disposed within a developing device and capacity of a recycle toner supplied into the developing device are detected;

wherein when the rotational torque of said stirring member is elevated and the capacity of said recycle toner is increased, control operation is executed such that a development bias voltage is not changed and lowering rotational speed of said stirring member is lowered; and wherein when the rotational torque of said stirring member is elevated and the capacity of said recycle toner is not increased, control operation is executed such that rotational speed of said stirring member is not changed.

2. The image forming apparatus according to claim 1, wherein the capacity of said recycle toner is detected by a level sensor disposed in the vicinity of a supply port of the recycle toner and on the basis of a change in height of a developer within a developing device.

3. The image forming apparatus according to claim 2, wherein said recycle toner is supplied to said developing device directly through a toner carrying tube from a cleaning device.

4. A controlling method of an image forming apparatus having a toner recycle mechanism comprising:

detecting rotational torque of a stirring member disposed within a developing device and capacity of a recycle toner supplied into the developing device;

wherein when the rotational torque of said stirring member is elevated and the capacity of said recycle toner is increased, executing control operation for not changing a development bias voltage and lowering rotational speed of said stirring member; and wherein when the rotational torque of said stirring member is elevated and the capacity of said recycle toner is not increased, executing control operation for not changing rotational speed of said stirring member.

5. The controlling method according to claim 4, wherein the capacity of said recycle toner is detected by a level sensor disposed in the vicinity of a supply port of the recycle toner and on the basis of a change in height of a developer within a developing device.

6. The controlling method according to claim 5, wherein said recycle tuner is supplied to said developing device directly through a toner canying tube from a clearing device.

* * * * *